US010646746B1

(12) United States Patent
Gomberg et al.

(10) Patent No.: US 10,646,746 B1
(45) Date of Patent: May 12, 2020

(54) ADJUSTABLE REHABILITATION AND EXERCISE DEVICE

(71) Applicant: ROM3 Rehab LLC, Las Vegas, NV (US)

(72) Inventors: Sanford Gomberg, Las Vegas, NV (US); Peter Arn, Pasadena, CA (US)

(73) Assignee: ROM TECHNOLOGIES, INC., Las Vegas, NV (US)

( * ) Notice: Subject to any disclaimer, the term of this patent is extended or adjusted under 35 U.S.C. 154(b) by 13 days.

(21) Appl. No.: 16/241,167

(22) Filed: Jan. 7, 2019

Related U.S. Application Data

(63) Continuation-in-part of application No. 15/700,308, filed on Sep. 11, 2017, and a continuation-in-part of (Continued)

(51) Int. Cl.
*A63B 22/06* (2006.01)
*A63B 21/00* (2006.01)
*A63B 21/015* (2006.01)

(52) U.S. Cl.
CPC .... *A63B 22/0605* (2013.01); *A63B 21/00069* (2013.01); *A63B 21/015* (2013.01); *A63B 21/4049* (2015.10); *A63B 2225/09* (2013.01)

(58) Field of Classification Search
CPC ..... A63B 21/00069; A63B 21/015; A63B 21/225; A63B 22/0002; A63B 22/0005; (Continued)

(56) References Cited

U.S. PATENT DOCUMENTS 59,915 A 11/1866 Lallement
363,522 A 5/1887 Knous
(Continued)

FOREIGN PATENT DOCUMENTS

CN 105620643 A 6/2016
DE 95019 7/1897
(Continued)

OTHER PUBLICATIONS

PCT International Search Report and Written Opinion, PCT/US17/50895, dated Jan. 12, 2018; 6 pages.
(Continued)

*Primary Examiner* — Joshua Lee
(74) *Attorney, Agent, or Firm* — Dickinson Wright PLLC

(57) ABSTRACT

An adjustable rehabilitation and exercise device, including a rotary member having a plurality of elongated and spaced apart elongated open-ended slots defined thereon, each slot including a plurality of enlargements along the length thereof. A mount is selectively and movably positionable on a selected one of the slots of the rotary member to select an angular location of the mount. The mount includes a slide member movably positionable along the selected slot to a selected radial location along the selected slot to select a radial location of the mount relative to the hub of the rotary member. The mount includes a movable pin having an enlarged head. The pin is positionable to selectively engage the enlarged head thereof within the enlargements of the slot so as to lock the position of the mount along the slot. A patient engagement member is connectable to the mount and movable with the mount.

4 Claims, 10 Drawing Sheets

Related U.S. Application Data application No. 15/700,298, filed on Sep. 11, 2017, now Pat. No. 10,173,095, and a continuation-in-part of application No. 15/700,327, filed on Sep. 11, 2017, now Pat. No. 10,173,097, and a continuation-in-part of application No. 15/700,293, filed on Sep. 11, 2017, now Pat. No. 10,173,094, and a continuation-in-part of application No. 15/700,287, filed on Sep. 11, 2017, now Pat. No. 10,226,663, and a continuation-in-part of application No. 15/700,320, filed on Sep. 11, 2017, now Pat. No. 10,173,096.

(60) Provisional application No. 62/393,348, filed on Sep. 12, 2016.

(58) Field of Classification Search

CPC ..... A63B 22/0007; A63B 22/0015; A63B 22/0046; A63B 22/0605; A63B 69/16; A63B 2022/0611; A63B 2022/0623; A63B 2022/0635; A63B 2069/161; A63B 2220/30; A63B 2225/09; A63B 21/4049

See application file for complete search history.

(56) References Cited

U.S. PATENT DOCUMENTS

| | | | |
|---|---|---|---|
| 446,671 | A | 2/1891 | Elliott |
| 610,157 | A | 8/1898 | Campbell |
| 631,276 | A | 8/1899 | Bullova |
| 823,712 | A | 6/1906 | Uhlmann |
| 1,149,029 | A | 8/1915 | Clark |
| 1,227,743 | A | 5/1917 | Burgedorff |
| 1,784,230 | A | 12/1928 | Freeman |
| 3,081,645 | A | 3/1963 | Bergfors |
| 3,100,640 | A | 8/1963 | Weitzel |
| 3,137,014 | A | 6/1964 | Meucci |
| 3,143,316 | A | 8/1964 | Shapiro |
| 3,713,438 | A | 1/1973 | Knutsen |
| 3,744,480 | A | 7/1973 | Gause et al. |
| 3,888,136 | A | 6/1975 | Lapeyre |
| 4,079,957 | A | 3/1978 | Blease |
| 4,408,613 | A | 10/1983 | Relyea |
| 4,436,097 | A | 3/1984 | Cunningham |
| 4,446,753 | A | 5/1984 | Nagano |
| 4,477,072 | A | 10/1984 | DeCloux |
| 4,499,900 | A | 2/1985 | Petrofsky et al. |
| 4,509,742 | A | 4/1985 | Cones |
| 4,606,241 | A | 8/1986 | Fredriksson |
| 4,611,807 | A | 9/1986 | Castillo |
| 4,648,287 | A | 3/1987 | Preskitt |
| 4,673,178 | A | 6/1987 | Dwight |
| 4,824,104 | A | 4/1989 | Bloch |
| 4,850,245 | A | 7/1989 | Feamster et al. |
| 4,858,942 | A | 8/1989 | Rodriguez |
| 4,869,497 | A | 9/1989 | Stewart et al. |
| 4,915,374 | A | 4/1990 | Watkins |
| 4,930,768 | A | 6/1990 | Lapcevic |
| 4,961,570 | A | 10/1990 | Chang |
| 5,027,794 | A | 7/1991 | Pyle |
| 5,161,430 | A | 11/1992 | Febey |
| 5,247,853 | A | 9/1993 | Dalebout |
| D342,299 | S | 12/1993 | Birrell et al. |
| 5,282,748 | A | 2/1994 | Little |
| 5,316,532 | A | 5/1994 | Butler |
| 5,324,241 | A | 6/1994 | Artigues et al. |
| 5,336,147 | A | 8/1994 | Sweeney, III |
| 5,338,272 | A | 8/1994 | Sweeney, III |
| 5,361,649 | A | 11/1994 | Slocum, Jr. |
| 5,458,022 | A | 10/1995 | Mattfeld et al. |
| 5,487,713 | A | 1/1996 | Butler |
| 5,566,589 | A | 10/1996 | Buck |
| 5,580,338 | A | 12/1996 | Scelta et al. |
| 5,676,349 | A | 10/1997 | Wilson |
| 5,685,804 | A | 11/1997 | Whan-Tong et al. |
| 5,860,941 | A | 1/1999 | Saringer et al. |
| 5,950,813 | A | 9/1999 | Hoskins et al. |
| 6,053,847 | A | 4/2000 | Stearns et al. |
| 6,077,201 | A | 6/2000 | Cheng |
| 6,102,834 | A | 8/2000 | Chen |
| 6,155,958 | A | 12/2000 | Goldberg |
| 6,253,638 | B1 | 7/2001 | Bermudez |
| 6,371,891 | B1 | 4/2002 | Speas |
| 6,430,436 | B1 | 8/2002 | Richter |
| 6,474,193 | B1 | 11/2002 | Farney |
| 6,543,309 | B2 | 4/2003 | Heim |
| 6,589,139 | B1 | 7/2003 | Butterworth |
| 6,640,662 | B1 | 11/2003 | Baxter |
| 6,820,517 | B1 | 11/2004 | Farney |
| 6,865,969 | B2 | 3/2005 | Stevens |
| 6,895,834 | B1 | 5/2005 | Baatz |
| 7,204,788 | B2 | 4/2007 | Andrews |
| 7,226,394 | B2 | 6/2007 | Johnson |
| 7,594,879 | B2 | 9/2009 | Johnson |
| 9,044,630 | B1 | 6/2015 | Lampert et al. |
| 9,312,907 | B2 | 4/2016 | Auchinleck et al. |
| 9,480,873 | B2 | 11/2016 | Chuang |
| 9,713,744 | B2 | 7/2017 | Suzuki |
| 9,919,198 | B2 | 3/2018 | Romeo et al. |
| 10,424,033 | B2 | 9/2019 | Romeo |
| 2003/0092536 | A1 | 5/2003 | Romanelli et al. |
| 2003/0109814 | A1 | 6/2003 | Rummerfield |
| 2004/0172093 | A1 | 9/2004 | Rummertield |
| 2004/0194572 | A1 | 10/2004 | Kim et al. |
| 2005/0015118 | A1 | 1/2005 | Davis et al. |
| 2005/0020411 | A1 | 1/2005 | Andrews |
| 2005/0085346 | A1* | 4/2005 | Johnson ..... A63B 22/0002 482/57 |
| 2005/0085353 | A1 | 4/2005 | Johnson |
| 2005/0274220 | A1 | 12/2005 | Reboullet |
| 2006/0003871 | A1 | 1/2006 | Houghton et al. |
| 2006/0247095 | A1 | 11/2006 | Rummertield |
| 2008/0161166 | A1 | 7/2008 | Lo |
| 2009/0211395 | A1 | 8/2009 | Mul'e |
| 2010/0248905 | A1 | 9/2010 | Lu |
| 2012/0167709 | A1 | 7/2012 | Chen et al. |
| 2012/0190502 | A1 | 7/2012 | Paulus et al. |
| 2013/0123071 | A1 | 5/2013 | Rhea |
| 2014/0194250 | A1 | 7/2014 | Reich et al. |
| 2016/0023081 | A1 | 1/2016 | Popa-Simil et al. |
| 2016/0302721 | A1 | 10/2016 | Wiedenhoefer et al. |
| 2017/0113092 | A1 | 4/2017 | Johnson |
| 2017/0143261 | A1 | 5/2017 | Wedenhoefer et al. |
| 2017/0147789 | A1 | 5/2017 | Wiedenhoefer et al. |
| 2017/0181698 | A1 | 6/2017 | Wiedenhoefer et al. |
| 2017/0265800 | A1 | 9/2017 | Auchinleck et al. |
| 2018/0071566 | A1 | 3/2018 | Gomberg et al. |
| 2018/0071569 | A1 | 3/2018 | Gomberg et al. |
| 2018/0071570 | A1 | 3/2018 | Gomberg et al. |
| 2018/0071571 | A1 | 3/2018 | Gomberg et al. |
| 2018/0071572 | A1 | 3/2018 | Gomberg et al. |
| 2018/0085615 | A1 | 3/2018 | Astolfi et al. |
| 2018/0271432 | A1 | 9/2018 | Auchinleck et al. |
| 2018/0280784 | A1 | 10/2018 | Romeo et al. |

FOREIGN PATENT DOCUMENTS

| | | | |
|---|---|---|---|
| DE | 7628633 | U1 | 12/1977 |
| DE | 8519150 | U1 | 10/1985 |
| DE | 3732905 | A1 | 7/1988 |
| DE | 29620008 | U1 | 2/1997 |
| DE | 19619820 | C2 | 1/2001 |
| DE | 19947926 | A1 | 4/2001 |
| EP | 0199600 | A2 | 10/1986 |
| EP | 0634319 | A2 | 1/1995 |
| EP | 1034817 | A1 | 9/2000 |
| EP | 3264303 | A1 | 3/2018 |
| FR | 2527541 | A2 | 12/1983 |
| GB | 141664 | A | 11/1920 |
| GB | 2336140 | A | 10/1999 |
| GB | 2372459 | A | 8/2002 |
| WO | 9809687 | A1 | 3/1998 |
| WO | 2006012694 | A1 | 2/2006 |

(56) References Cited

FOREIGN PATENT DOCUMENTS

OTHER PUBLICATIONS

Claris Reflex; "Better Patients Lower Costs", 2018, five pages, Claris Healthcare, Inc. Vancouver, British Columbia, Canada.

* cited by examiner

ADJUSTABLE REHABILITATION AND EXERCISE DEVICE

FIELD

This disclosure relates to the field of rehabilitation devices. More particularly, this disclosure relates to adjustable rehabilitation devices having improved connection and adjustability of patient engagement members.

BACKGROUND

Improvement is desired in the construction of adjustable rehabilitation and exercise devices. Adjustable rehabilitation and exercise devices having pedals on opposite sides and adjustably positionable relative to one another have been proposed. However, such designs require improvement due to the fact that the pedals tend to not remain securely mounted and detach, wobble and the like. In addition, it is desirable to provide for an adjustable rehabilitation or exercise device that is capable of providing both powered motion or user initiated motion without the need for separate devices.

Accordingly, in one aspect, the disclosure provides an adjustable rehabilitation and exercise device having improved structure for locating patient engagement members.

SUMMARY

The disclosure provides an adjustable rehabilitation and exercise device.

In one aspect, an adjustable rehabilitation and exercise device includes a rotary member having a plurality of elongated and spaced apart elongated open-ended slots defined thereon, each slot including a plurality of enlargements along the length thereof. A mount is selectively and movably positionable on a selected one of the slots of the rotary member to select an angular location of the mount.

The mount includes a slide member movably positionable along the selected slot to a selected radial location along the selected slot to select a radial location of the mount relative to the hub of the rotary member. The mount includes a movable pin having an enlarged head.

The pin is positionable to selectively engage the enlarged head thereof within the enlargements of the slot so as to lock the position of the mount along the slot. A patient engagement member is connectable to the mount and movable with the mount.

BRIEF DESCRIPTION OF THE DRAWINGS

Further advantages of the disclosure are apparent by reference to the detailed description when considered in conjunction with the figures, which are not to scale so as to more clearly show the details, wherein like reference numbers indicate like elements throughout the several views, and wherein.

DETAILED DESCRIPTION

Figure 1A:
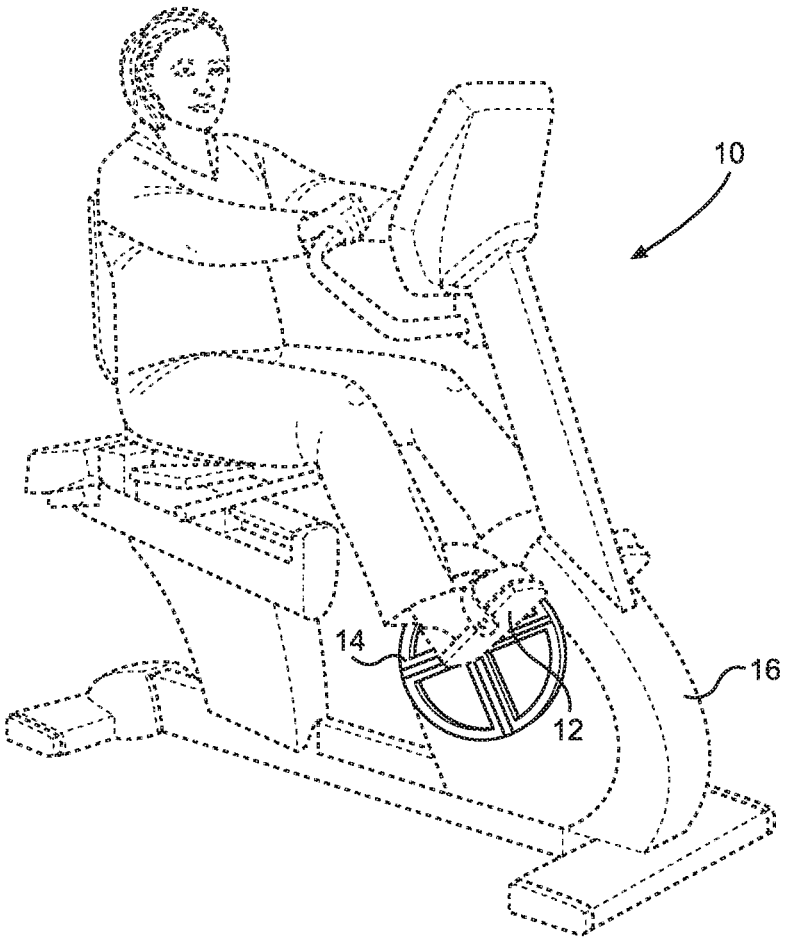
FIGS. 1A and 1B are perspective views of an adjustable rehabilitation and exercise device according to the disclosure configured to have adjustably positionable patient engagement members.
Figure 1B:
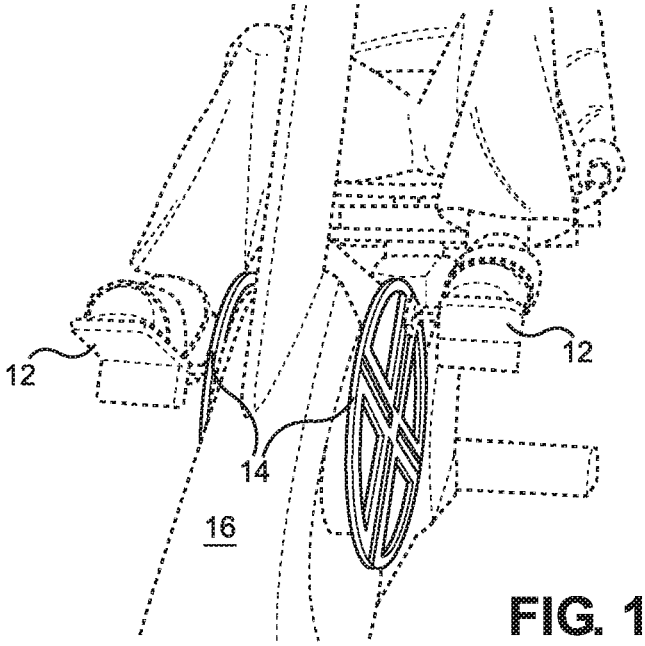

With initial reference to FIGS. 1A-1B, there is shown an adjustable rehabilitation and exercise device 10 having patient engagement members, such as pedals 12 on opposite sides that are adjustably positionable relative to one another, but securely mounted according to the disclosure to provide a more secure mounting that avoids disconnection, wobbling and the like often experienced with prior devices.

The device 10 includes a rotary device such as a wheel 14 or flywheel or the like rotatably mounted such as by a hub to a frame 16 or other support. The pedal 12 is configured for interacting with a patient to be rehabilitated and may be configured for use with lower body extremities such as the feet, legs, or upper body extremities such as the hands, arms, and the like. For example, the pedal 12 may be a conventional bicycle pedal of the type having a foot support rotatably mounted onto an axle with bearings. The axle has exposed end threads for engaging a mount on the wheel 14 to locate the pedal on the wheel 14.

The wheel 14 may be configured to have both pedals 12 on opposite sides of a single wheel. However, a preferred construction, as seen in FIGS. 1A and 1B shows a pair of the wheels 14 spaced apart from one another but interconnected to a flywheel or the like.

The rehabilitation and exercise device 10 of FIGS. 1A-1B may take the form as depicted of a traditional exercise/rehabilitation device which is more or less non-portable and remains in a fixed location, such as a rehabilitation clinic or medical practice.

Alternatively, the device 10 may be configured to be smaller and more portable unit so that it is able to be easily transported to different locations at which rehabilitation or treatment is to be provided, such as a plurality of patient's homes, alternative care facilities or the like.

With reference to FIGS. 2-10, there is shown a wheel system 20 having a patient engagement member, such as a pedal corresponding to the pedal 12 above, adjustably mountable on a wheel 24 by an adjustable mount 26.

Figure 2:
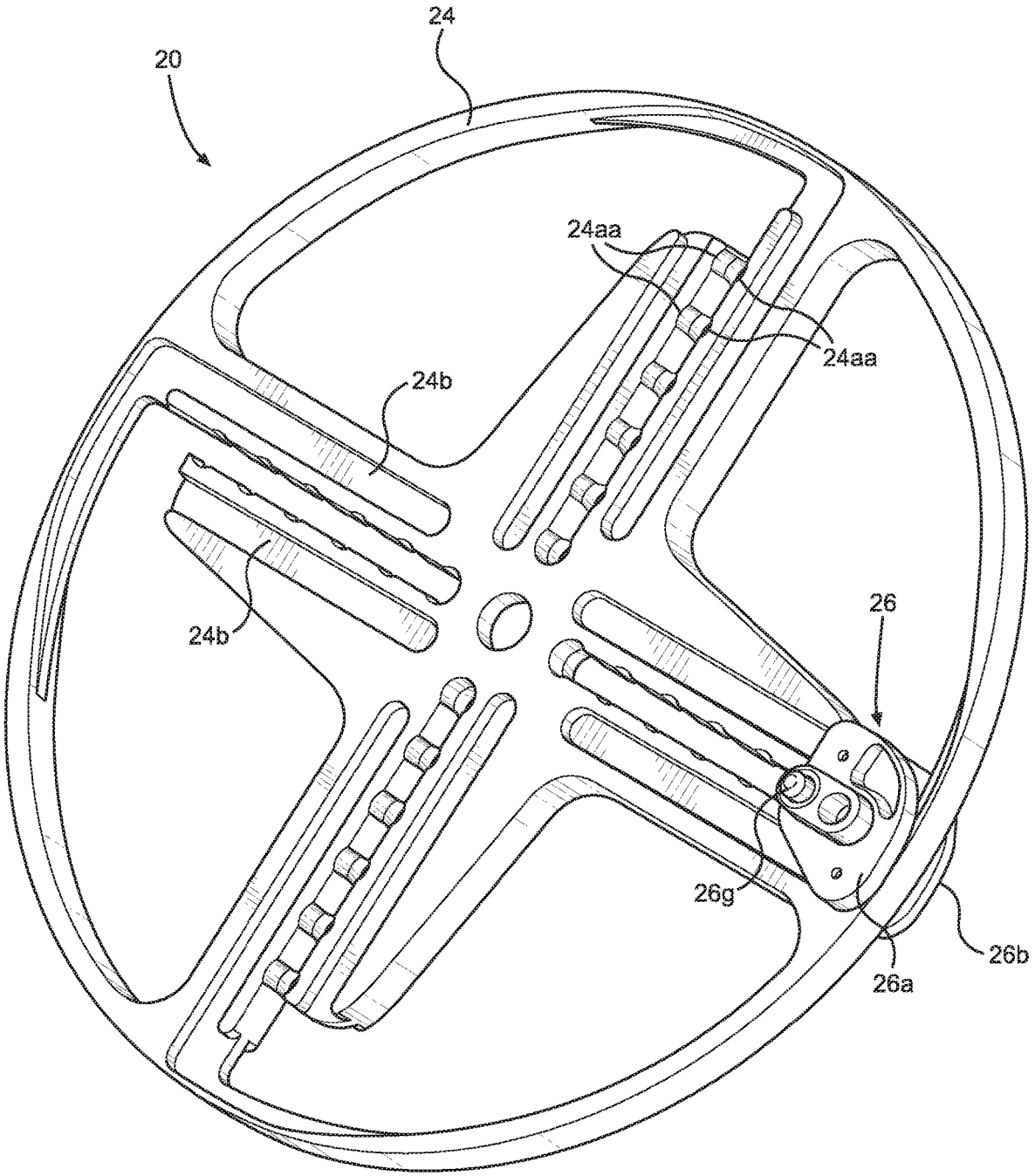
FIGS. 2-10 show a wheel system for adjustably positioning a patient engagement member.
Figure 3:
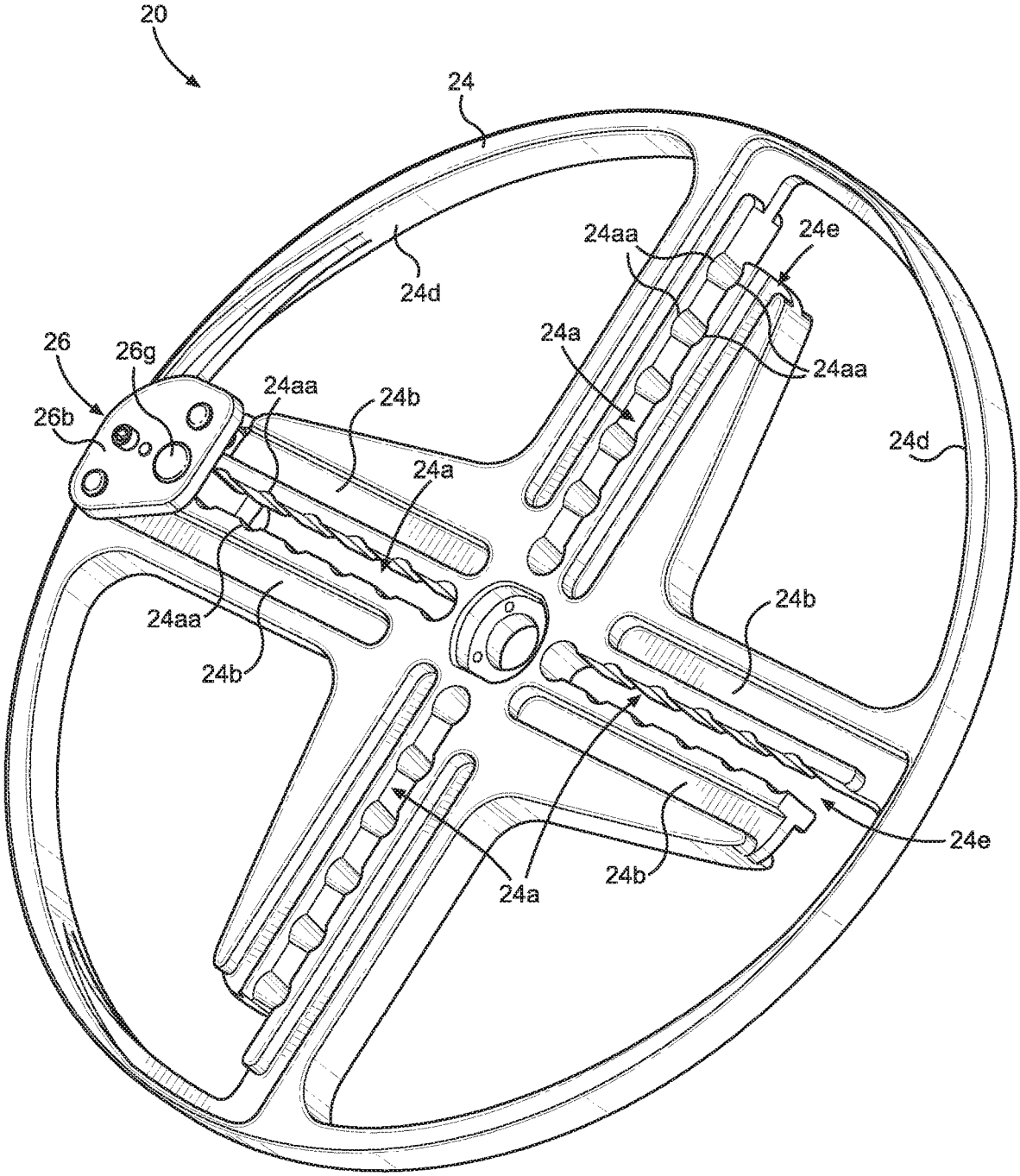
Figure 4:
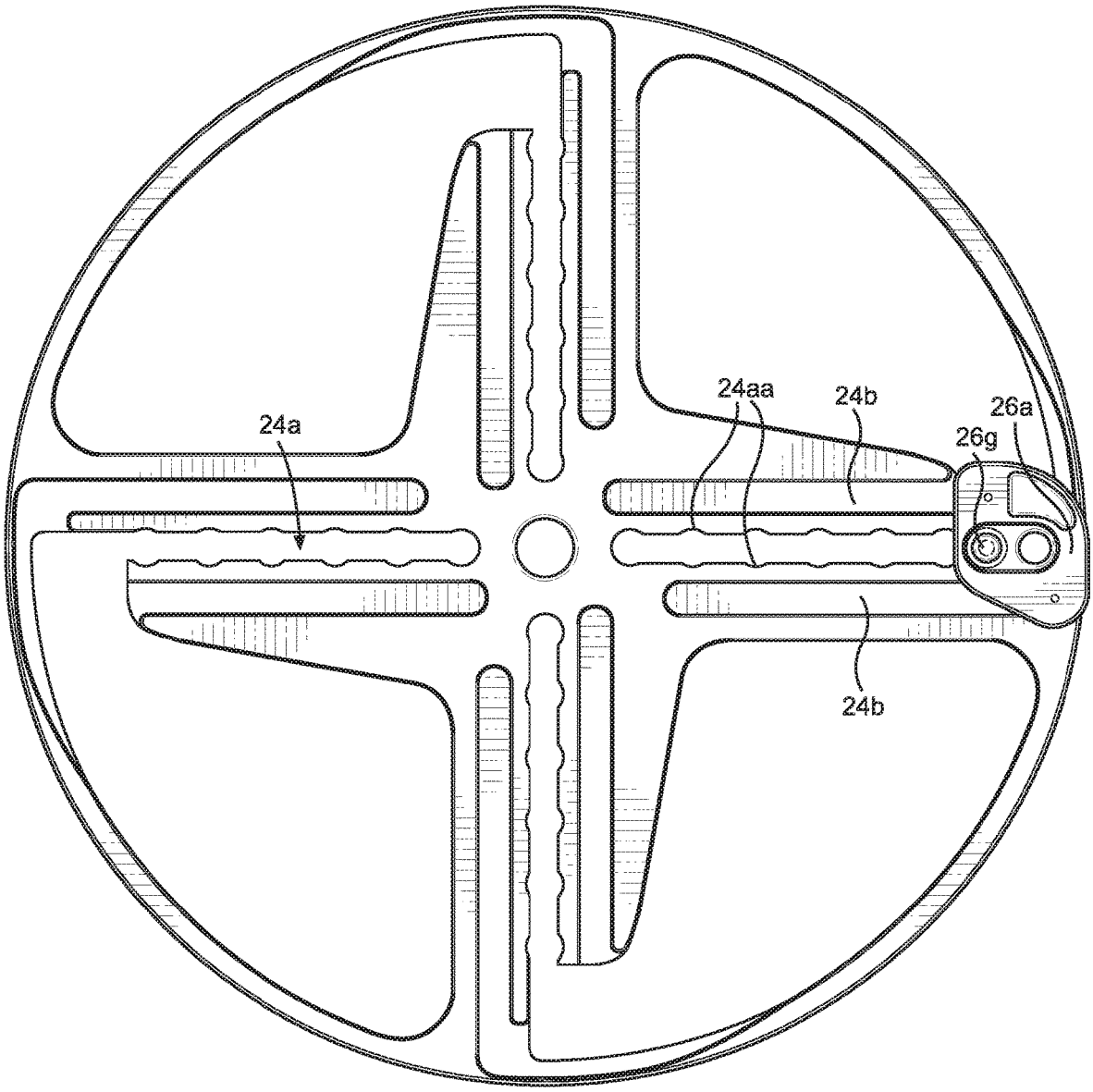
Figure 5:
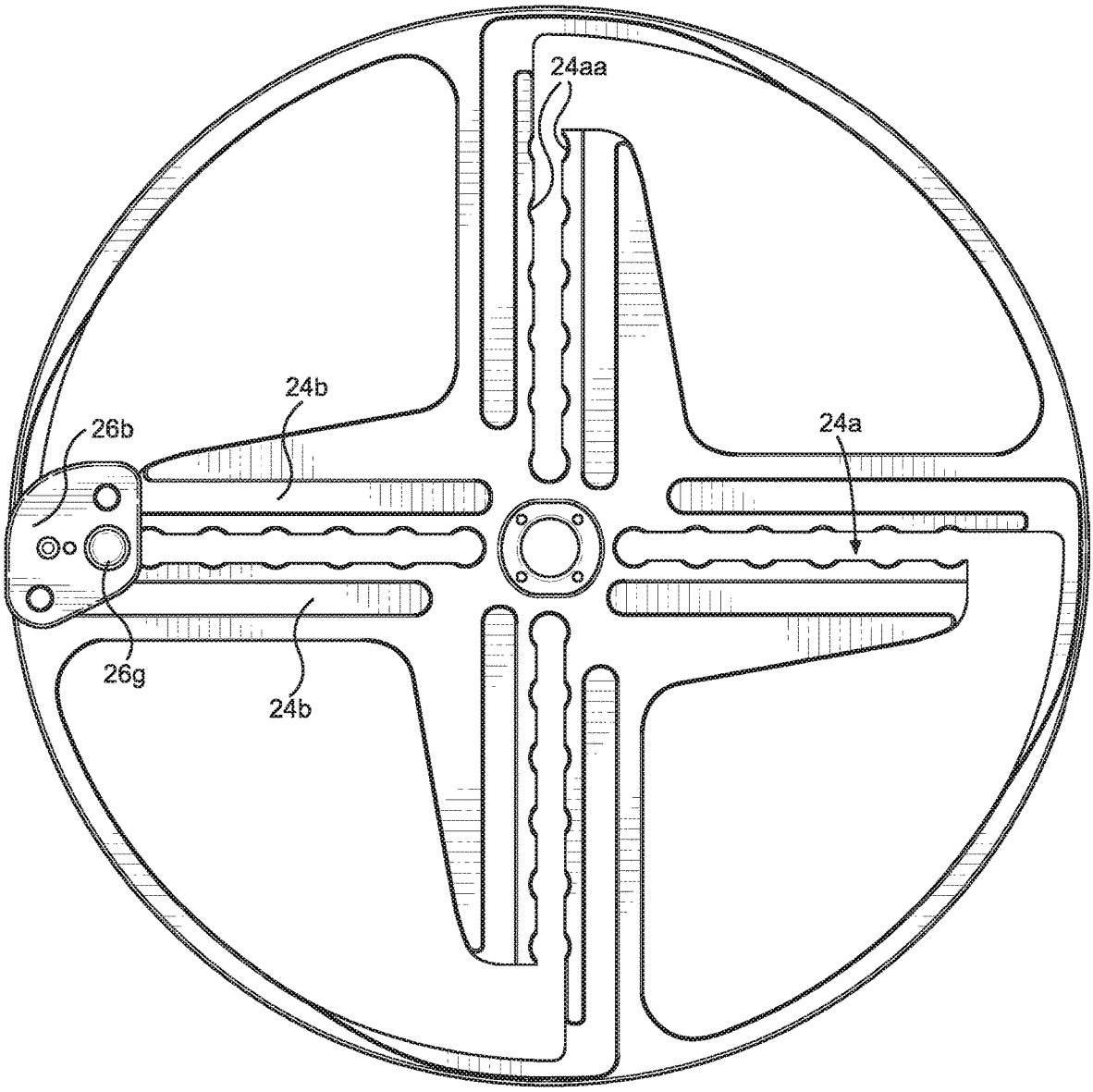
Figure 6:
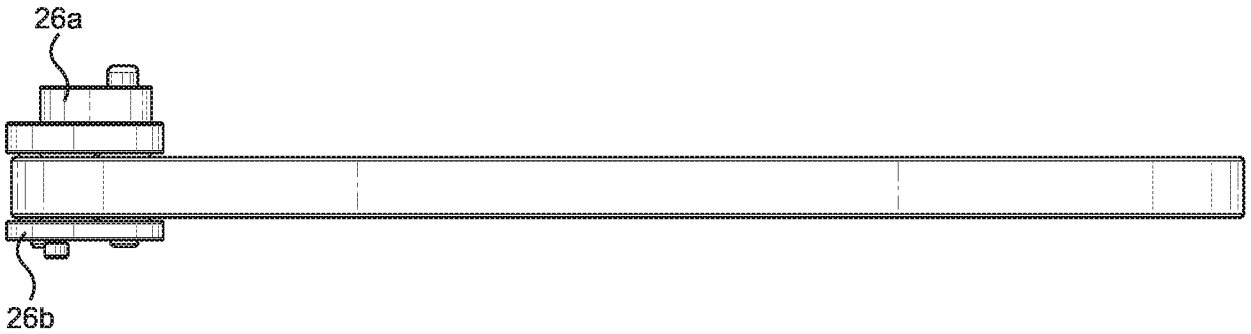
Figure 7:
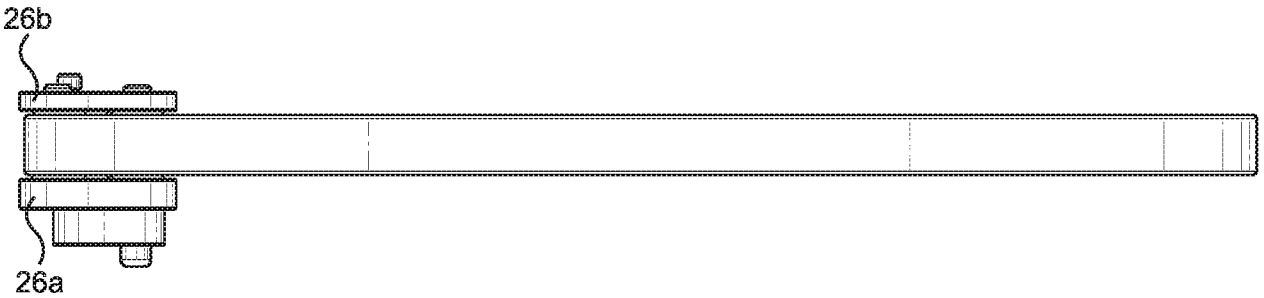
Figure 8:
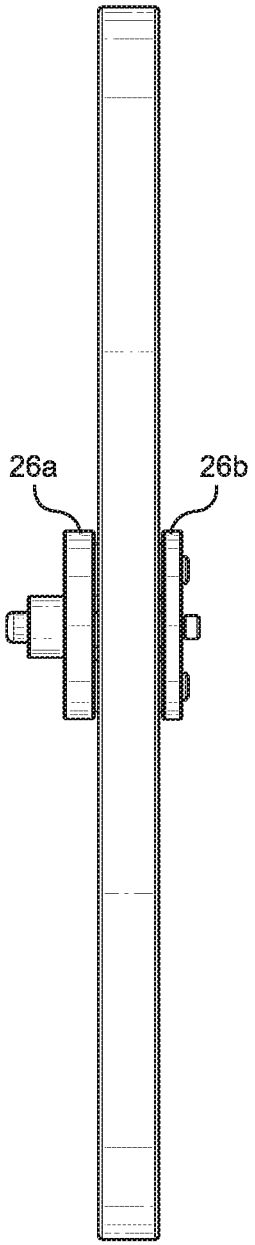
Figure 9:
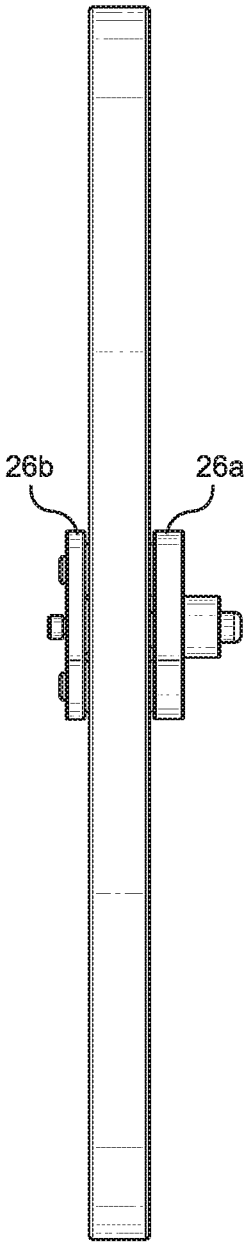

FIG. 2 shows a front side of the wheel 24, and FIG. 3 shows a rear side of the wheel 24. The wheel 24 is a disk configured to include a plurality of spaced apart elongated slots 24*a* formed through the thickness of the wheel 24 to receive the mount 26. The slots 24*a* include enlargements 24*aa*. A pair grooves 24*b* are formed on each side the wheel 24 parallel to and on opposite sides of the slots 24*a*. The wheel 24 also includes a central mounting aperture 24*c* to provide a hub for rotatably mounting of the wheel 24 to the device 10. Material of the wheel 24 may be removed to provide openings 24*d* to provide aesthetics and for reducing the weight and the cost of the wheel 24. The slots 24*a* and the grooves 24*b* desirably have open ends to facilitate installation and removal of the mount 26.

Figure 10:
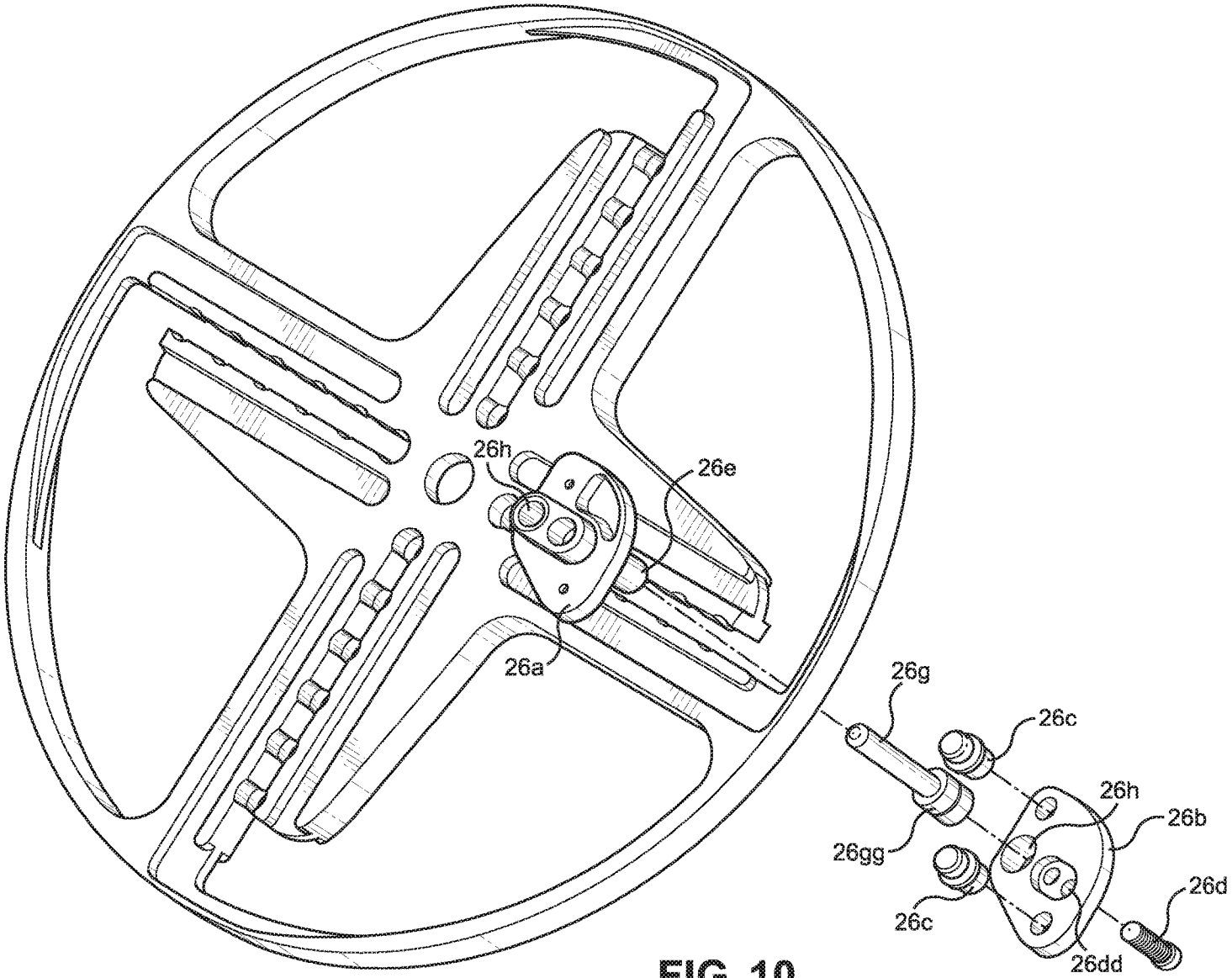
Figure 11:
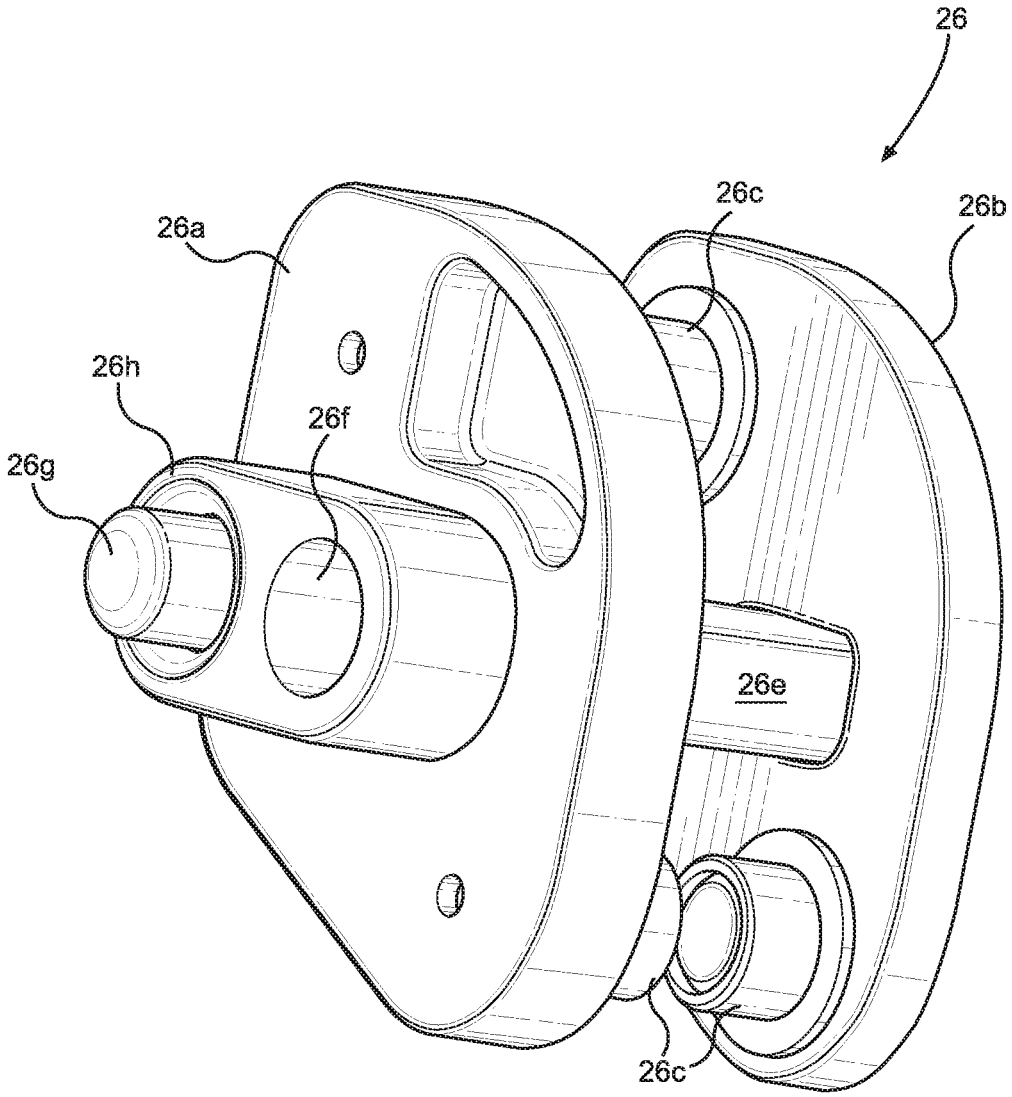
FIGS. 11 and 12 show an adjustable mount of the wheel system.
Figure 12:
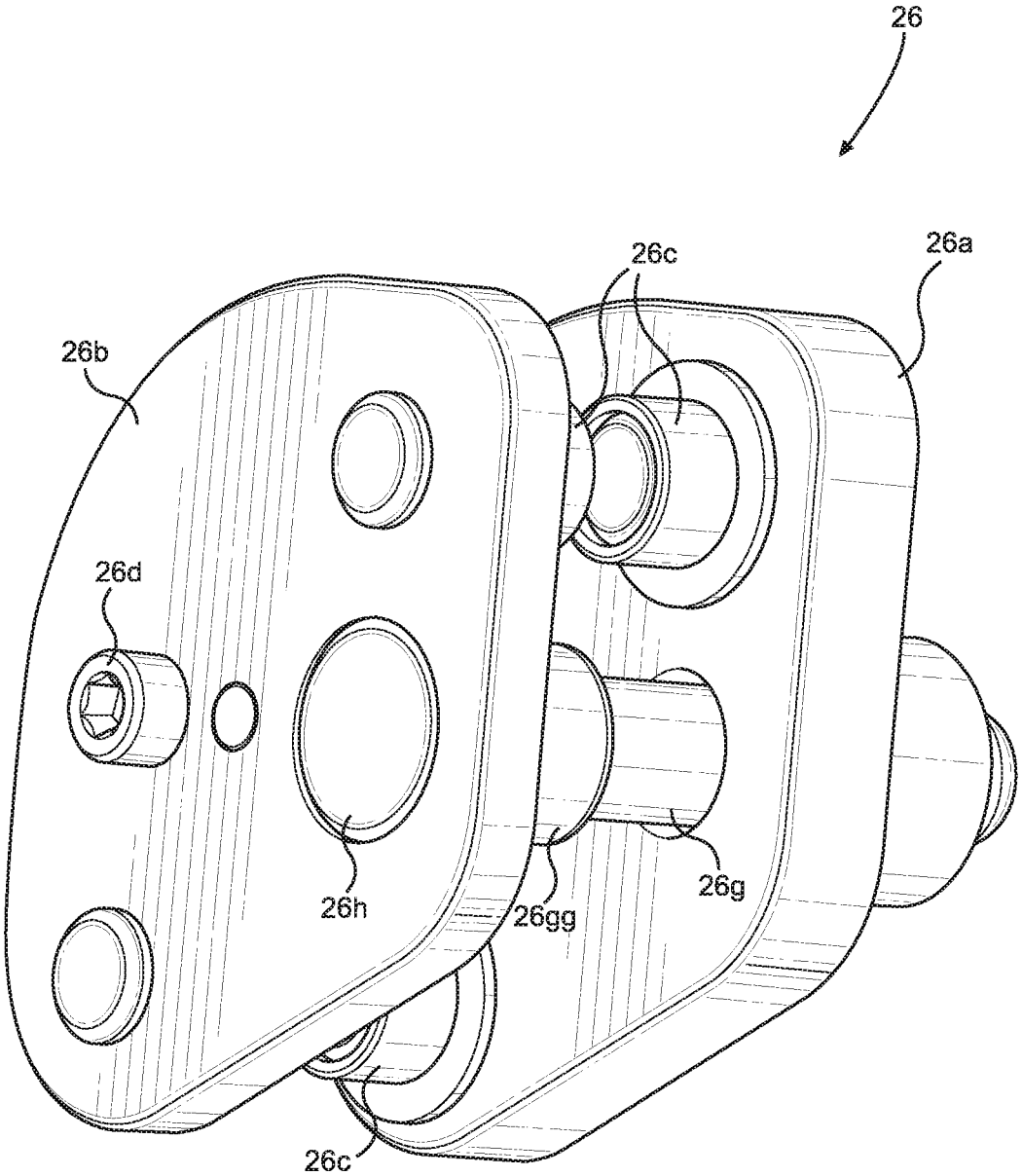

The mount 26 includes a front sliding member 26*a* and a rear sliding member 26*b*. The sliding members 26*a* and 26*b* each include pegs 26*c* on their inner sides for slidingly engaging he grooves 24*b* of the wheel 24. The sliding members 26*a* and 26*b* are fixed together as by a threaded fastener 26*d* that extends through a bore 26*dd* of the sliding member 26*b* and into a corresponding post 26*e* of the sliding member 26*a* (FIG. 10). The sliding member 26*a* includes a receiver 26*f* configured to receive an axle of the pedal or other patient engagement member. A lock pin 26*g* is provided to extend through aligned bores 26*h* of the sliding members 26*a* and 26*b* and pass through one of the enlargements 24*aa* of the slot 24*a* to selectively lock the position of the mount 26, as explained more fully below.

The mount 26 is slidable along the slot 24*a* and the grooves 24*b* when the lock pin 26*g* is not installed. The lock pin 26*g* is installed through the aligned bores 26*h* and the enlarged head 26*gg* is passable into the slot 24*a* when the head 26*gg* is aligned with one of the enlargements 24*aa*, thus seating the head 26*gg* in one of the enlargements 24*aa*, and locking the mount 26 in position. The position of the mount 26 may be adjusted by alternating the seating of the head 26*gg* in the various enlargements 24*aa* of the slot 24*a*. In this manner, the sliding mount 26 may be moved along the slot 24*a* to change its radial location on the wheel 24.

The mount 26 is configured to stably locate a pedal or other patient engagement member and eliminate wobble and the like associated with conventional devices. In addition, the mount 26 is also configured to advantageously enable substantially incremental adjustment of the position of the mount.

The mount 26 cooperates with the slot 24*a* and the grooves 24*b* to adjustably position the mount 26, and hence the pedal, relative to the hub of the wheel 24. Further, the availability of a plurality of slots 24*a* enables a user to select which slot 24*a* for installation of the mount 26. Thus, in combination, the mount 26 and the slots 24*a* with their respective grooves 24*b* enable radial and angular adjustment of the position of the pedal or other patient engagement member. When this manner of adjustment is used for both of the pedals on opposite sides of the device 10, it will be appreciated that the pedals, or other patient engagement members, may be adjustably positioned relative to one another angularly, with each pedal being radially adjustable relative to the hubs of the wheels.

The foregoing description of preferred embodiments for this disclosure has been presented for purposes of illustration and description. It is not intended to be exhaustive or to limit the disclosure to the precise form disclosed. Obvious modifications or variations are possible in light of the above teachings. The embodiments are chosen and described in an effort to provide the best illustrations of the principles of the disclosure and its practical application, and to thereby enable one of ordinary skill in the art to utilize the disclosure in various embodiments and with various modifications as are suited to the particular use contemplated. All such modifications and variations are within the scope of the disclosure

The invention claimed is:

1. An adjustable rehabilitation and exercise device, comprising:

a rotary member having a plurality of elongated and spaced apart elongated open-ended slots defined thereon, each slot including a plurality of enlargements along the length thereof;

a mount selectively and movably positionable on a selected one of the slots of the rotary member to select an angular location of the mount, the mount including a slide member movably positionable along the selected slot to a selected radial location along the selected slot to select a radial location of the mount relative to a hub of the rotary member, the mount including a movable pin having an enlarged head, wherein the pin is positionable to selectively engage the enlarged head thereof within one of the enlargements of the slot so as to lock the position of the mount along the slot; and a patient engagement member connectable to the mount and movable with the mount.

2. The device of claim 1, wherein the enlargements are uniformly spaced along the length of the slot.

3. The device of claim 1, further comprising grooves on opposite sides of the slot parallel to the slot, with the mount including pegs slidingly disposed within the grooves.

4. The device of claim 1, wherein the slide member includes a front slide member and a rear slide member located on opposite sides of the rotary member.

* * * * *